US012129748B1

(12) United States Patent
Alnafea et al.

(10) Patent No.: US 12,129,748 B1
(45) Date of Patent: Oct. 29, 2024

(54) ELECTRICAL SUBMERSIBLE PUMP Y-TOOL WITH PERMANENT COILED TUBING PLUG AND MILLABLE BALL VALVE

(71) Applicant: SAUDI ARABIAN OIL COMPANY, Dhahran (SA)

(72) Inventors: Abdulkareem K. Alnafea, Dammam (SA); Eyad O. Alshanqeety, Khobar (SA); Alaa Shawly, Hawtah (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 28 days.

(21) Appl. No.: 18/296,315

(22) Filed: Apr. 5, 2023

(51) Int. Cl.

| | |
|---|---|
| ***E21B 43/12*** | (2006.01) |
| ***E21B 23/00*** | (2006.01) |
| ***E21B 33/126*** | (2006.01) |
| ***E21B 34/06*** | (2006.01) |

(52) U.S. Cl.
CPC ..... *E21B 43/128* (2013.01); *E21B 23/00* (2013.01); *E21B 33/126* (2013.01); *E21B 34/06* (2013.01)

(58) Field of Classification Search
CPC ..... E21B 43/128; E21B 23/00; E21B 33/126; E21B 34/06
See application file for complete search history.

(56) References Cited

U.S. PATENT DOCUMENTS

| | | | | |
|---|---|---|---|---|
| 7,373,991 | B2 | 5/2008 | Vaidya et al. | |
| 10,167,708 | B2 * | 1/2019 | Beveridge | E21B 23/12 |
| 11,118,443 | B2 * | 9/2021 | Shammeri | E21B 34/12 |
| 11,346,194 | B2 * | 5/2022 | Al-Somali | E21B 34/10 |
| 11,384,622 | B2 | 7/2022 | Abdellatif et al. | |
| 11,859,476 | B2 * | 1/2024 | Al-Mousa | E21B 23/06 |
| 2019/0128098 | A1 | 5/2019 | Ross et al. | |

OTHER PUBLICATIONS

Schlumberger Artificial Lift Solutions Catalog; https://www.scribd.com/document/408011403/SLB-ALS-catalog-pdf.

* cited by examiner

*Primary Examiner* — Jonathan Malikasim
(74) *Attorney, Agent, or Firm* — Vorys, Sater, Seymour and Pease LLP

(57) ABSTRACT

An Electric Submersible Pump (ESP) is installed in a production branch of a Y-tool apparatus. A bypass branch of the Y-tool apparatus permits an intervention tool on a coiled tubing string to bypass the ESP for intervention operations in the wellbore. A permanent dynamic seal in the bypass branch includes an inflatable elastomeric chamber that forms a seal around the coiled tubing string while the coiled tubing is run-in and pulled out. A ball valve is also provided in the bypass branch. The dynamic seal and ball valve eliminate the need for blanking plugs to be retrieved and reset with slickline operations.

20 Claims, 3 Drawing Sheets

ELECTRICAL SUBMERSIBLE PUMP Y-TOOL WITH PERMANENT COILED TUBING PLUG AND MILLABLE BALL VALVE

FIELD OF THE DISCLOSURE

The present disclosure relates to electrical submersible pumps (ESPs) used in hydrocarbon development operations, and more specifically, to bypass systems for permitting tools to access portions of a wellbore downhole of an ESP installed in the wellbore.

BACKGROUND OF THE DISCLOSURE

In hydrocarbon developments, it is common practice to use ESP systems in a wellbore as a primary form of artificial lift, e.g., to assist in circulating hydrocarbons or other wellbore fluids to a surface location. However, with an ESP installed at an end of a production tubing, access to the reservoir downhole of the ESP is typically blocked. Reservoir access is often required for intervention or workover operations, such as to add additional perforations to provide fluid communication between the wellbore and the reservoir, to perform reservoir treatments such as acidizing or seale removal, or to run specialized logging tools on coiled tubing or wireline, which may assist in the identification of water or oil zones within the reservoir. Therefore, frequent reservoir access may be required with the ESP in place.

In some cases, an ESP is used with an associated bypass system, which permits access to the wellbore downhole of the ESP without removal of the ESP. A typical bypass system includes a Y-tool having a production branch and a bypass branch, both branches in communication with the surface location by a production tubing string. The ESP may be installed in the production branch, and the bypass branch may normally be sealed during production of the wellbore fluids through the production branch. The bypass branch may be sealed with a blanking plug to prevent recirculation of wellbore fluids discharged from the ESP back into the wellbore through the bypass branch. When an intervention is required, a wireline operation may first be required to retrieve the blanking plug and thereby open the bypass branch. When the intervention is complete, another wireline operation may be required to reset the blanking plug.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a Y-tool apparatus for conducting intervention operations in a wellbore includes a junction including a production conduit and a bypass conduit, the production conduit and the bypass conduit converging into an upper conduit within the junction. The Y-tool apparatus further includes an electrical submersible pump (ESP) fluidly coupled to the production conduit in a production branch of the Y-tool apparatus and a bypass passage fluidly coupled to the bypass conduit and extending through a bypass branch of the Y-tool apparatus. A closure valve is disposed in the bypass passage and selectively operable to move between a closed configuration, wherein flow through the bypass passage is obstructed, and an open configuration, wherein flow through the bypass passage is unobstructed. A dynamic seal is provided in the bypass passage and selectively operable to form a seal with a tubing string passing through the bypass passage.

In another embodiment, a system for conducting intervention operations in a wellbore includes a production tubing string extending into the wellbore and a junction coupled to a lower end of the production tubing string. The junction includes a production conduit and a bypass conduit, the production conduit and the bypass conduit converging into an upper conduit within the junction. An electrical submersible pump (ESP) is fluidly coupled to the production conduit in a production branch of the Y-tool apparatus. A bypass passage is fluidly coupled to the bypass conduit and extends through a bypass branch of the Y-tool apparatus. A closure valve is provided in the bypass passage, the closure valve being selectively operable to move between a closed configuration wherein flow through the bypass passage is obstructed and an open configuration wherein flow through the bypass passage is unobstructed. A dynamic seal provided in the bypass passage, the dynamic seal being selectively operable to form a seal with a tubing string passing through the bypass passage.

In another embodiment, a method for conducting an intervention operation in a wellbore includes (a) installing a Y-tool apparatus at a downhole location in the wellbore, (b) operating an electrical submersible pump (ESP) coupled in a production branch of the Y-tool apparatus to propel a wellbore fluid to a surface location, (c) conveying an intervention tool on a tubing string to a bypass passage extending through a bypass branch of the Y-tool apparatus, (d) opening a closure valve in the bypass passage to permit passage of the intervention tool through the bypass passage to a wellbore portion downhole of the ESP. (e) forming a dynamic seal with the tubing string above the intervention tool with a dynamic seal supported by the Y-tool apparatus and (f) performing the intervention operation with the intervention tool disposed in the wellbore portion downhole of the ESP.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
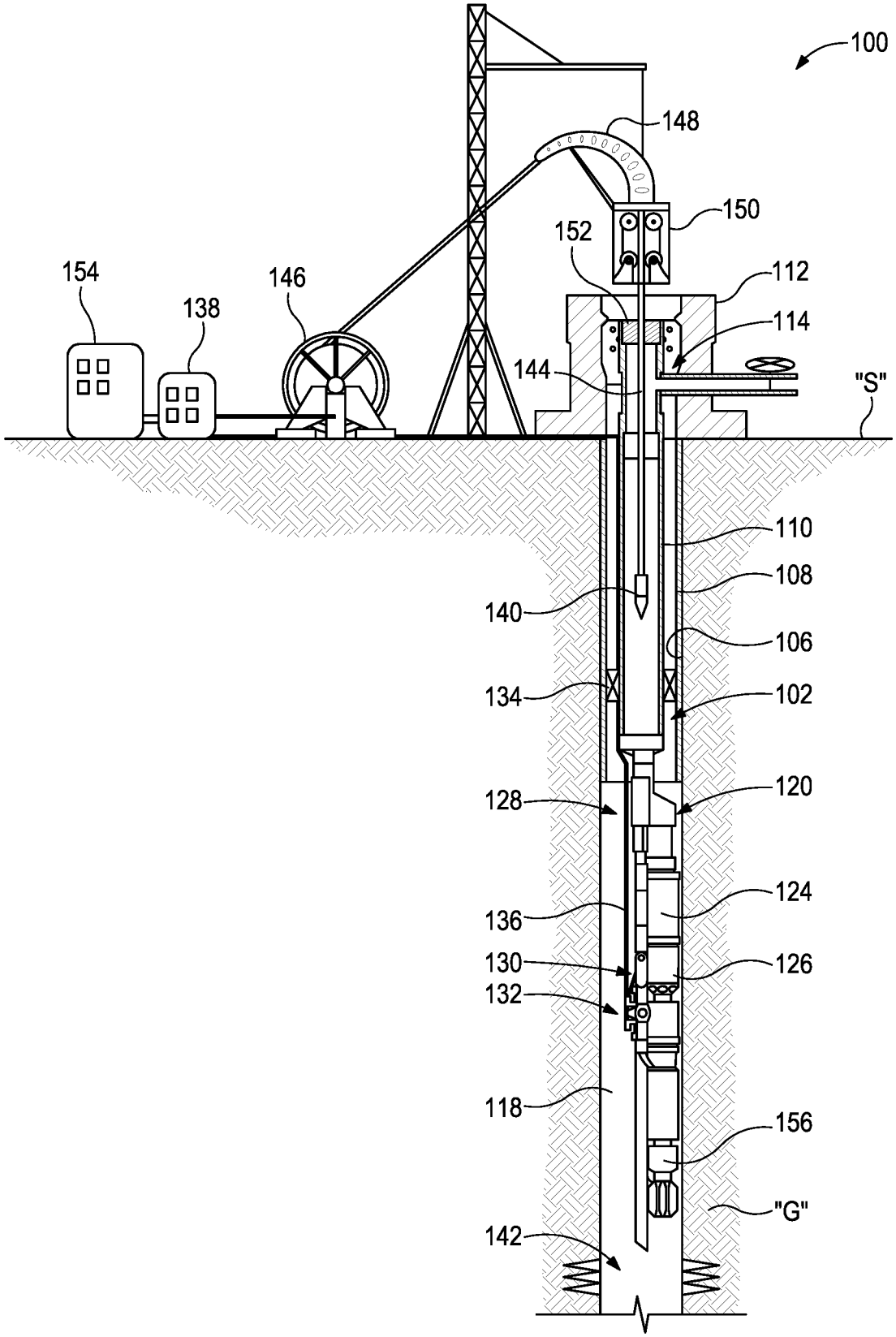
FIG. 1 is a cross-sectional view of a wellbore system including an ESP Y-tool apparatus in accordance with one or more aspects of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the seale of the elements presented in the accompanying Figures may vary without departing from the scope of the present disclosure.

Embodiments in accordance with the present disclosure generally relate to an Electric Submersible Pump (ESP) system installed in a production branch of a Y-tool apparatus. A bypass branch of the Y-tool apparatus permits coiled tubing or another type of wellbore conveyance to bypass the ESP to conduct intervention operations in the wellbore. The bypass branch of the Y-tool apparatus includes a permanent dynamic seal that seals around a coiled tubing string while the coiled tubing runs an intervention tool into and out of the wellbore. The dynamic seal may include an inflatable elastomer that is activated with a small capillary pressure control line installed in an annulus around the Y-tool apparatus. A millable ball valve is also provided in the bypass branch of the Y-tool below (downhole of) the dynamic seal. The millable ball valve may remain closed during normal operation of the ESP in production operations to prevent any backflow of the produced wellbore fluids through the bypass branch. The millable ball valve may be selectively opened to permit intervention through the bypass branch of the Y-tool, and may be selectively actuated by the same capillary pressure control line that controls the inflatable elastomer of the dynamic seal. The dynamic seal and millable ball valve eliminate the need for blanking plugs to be retrieved and reset with slickline operations.

FIG. 1 is a schematic view of an example wellbore system 100 including a Y-tool apparatus 102 in accordance with one or more exemplary embodiments of the disclosure. The wellbore system 100 includes a wellbore 106 extending from a surface location "S" and traversing a geologic formation "G." In the illustrated example, the wellbore 106 is substantially vertical. In other embodiments, aspects of the disclosure may be practiced in a wide variety of vertical, directional, deviated, slanted and/or horizontal portions therein, and may extend along any trajectory through the geologic formation "G." As illustrated in FIG. 1, the wellbore 106 is partially lined with a casing string 108, however, in other embodiments, the wellbore 106 may be uncased, without departing from the scope of the disclosure.

In the illustrated embodiment, the wellbore system 100 includes production tubing string 110 extending into the wellbore 106 from a wellhead 112 arranged at the surface location "S." The production tubing string 110 may be constructed of a series of pipe sections coupled to one another in an end-to-end manner, or in some embodiments, the production tubing string 110 may be a continuous string of flexible tubing. The wellhead 112 generally provides a suspension point for the casing string 108 and the production tubing string 110 and also provides pressure control for the wellbore 106. The wellhead 112 may include a system valves and adaptors that distribute wellbore fluids produced through the production tubing string 110 to appropriate destinations. For example, wellbore fluids may be directed from the production string 110 through a tee 114 to a collection tank, pipeline or other downstream destination.

The Y-tool apparatus 102 is fluidly coupled to and otherwise arranged a lower end of the production tubing string 110. Wellbore fluids from an annulus 118 defined around the Y-tool apparatus 102 may be drawn into or otherwise enter the production tubing string 110 through a production branch 120 of the Y-tool apparatus 102. A packer 134 may be provided within the annulus 118 to form an annular seal between the production tubing string 110 and the casing string 108. The production branch 120 generally includes an ESP 124 disposed therein, which may pump wellbore fluids through an intake 126 into the production tubing string 110. Backflow of wellbore fluids through a bypass branch 128 of the Y-tool apparatus 102 is prevented by a dynamic seal 130 and a closure valve 132 disposed in the bypass branch 128. The dynamic seal 130 and the closure valve 132 may be operated by a control line 136 extending through the annulus 118 to an actuator such as a hydraulic pump 138 at the surface location "S." The hydraulic pump 138 may transmit instructions for the dynamic seal 130 and the closure valve 132 through the control line 136 in the form of hydraulic control signals. In other embodiments, the hydraulic pump 138 may be provided at a downhole location without departing from the scope of the disclosure. In still other embodiments, the control line 136 may provide electric or pneumatic control signals for operating the dynamic seal 130 and the closure valve 132.

The bypass branch 128 may permit passage of an intervention tool 140 through the Y-tool apparatus to access a reservoir or a portion 142 of the wellbore 106 downhole of the ESP 124 without removing the ESP 124 from the wellbore 106. As described in greater detail below, the ESP 124 may continue to operate as the intervention tool 140 is passed (extended) through the bypass branch 128 and while performing an intervention in the wellbore portion 142. The intervention tool 140 may be operable to conduct any number of workover or intervention operations such as production logging operations, perforating, acidizing or other wellbore treatments.

In some embodiments, as illustrated, he intervention tool 140 may be conveyed through the production tubing string 110 on coiled tubing or a coiled tubing string 144. In other embodiments, the intervention tool 124 may be conveyed on slickline, wireline or another rig-less conveyance. The coiled tubing string 144 may be coiled at the surface location "S" on a spooling device 146 and may pass over a guide arch 148 which provides a bending radius for moving the coiled tubing string 144 to a vertical orientation for injection into the wellbore 106. From the guide arch 148, the coiled tubing string 144 passes into an injector 150, which grippingly engages the coiled tubing string 144 and pushes it through the wellhead 112 into the wellbore 106. The coiled tubing string 144 may pass through a seal 152 in the wellhead 112, which prevents wellbore fluids passing through the tee 114 from escaping while permitting the coiled tubing string 144 to be raised and lowered through the wellhead 112.

To operate the ESP 124, the hydraulic pump 138 (and the dynamic seal 130 and closure valve 132 coupled thereto by the control line 136), the intervention tool 140, the injector 150 and/or other components of the wellbore system 100, a controller 154 may be provided at the surface location "S." The controller 154 may be operably coupled to the hydraulic pump 138 and the other components of the wellbore system 100 to provide instructions thereto. In some embodiments, the controller 154 may also be communicatively coupled to a downhole sensor 156 or other devices to receive data therefrom. For example, the sensor 156 may be secured to the Y-tool apparatus 102 adjacent the intake 126 and may provide data regarding the composition or conditions of the wellbore fluids entering the Y-tool apparatus 102. In some embodiments, the controller 154 may be a computer-based system that may include a processor, a memory storage device, and programs and instructions, accessible to the processor for executing the instructions utilizing the data stored in the memory storage device. In other embodiments, the controller 154 may include manual controls that may be manipulated by an operator to control any of the procedures and equipment described herein.

Figure 2:
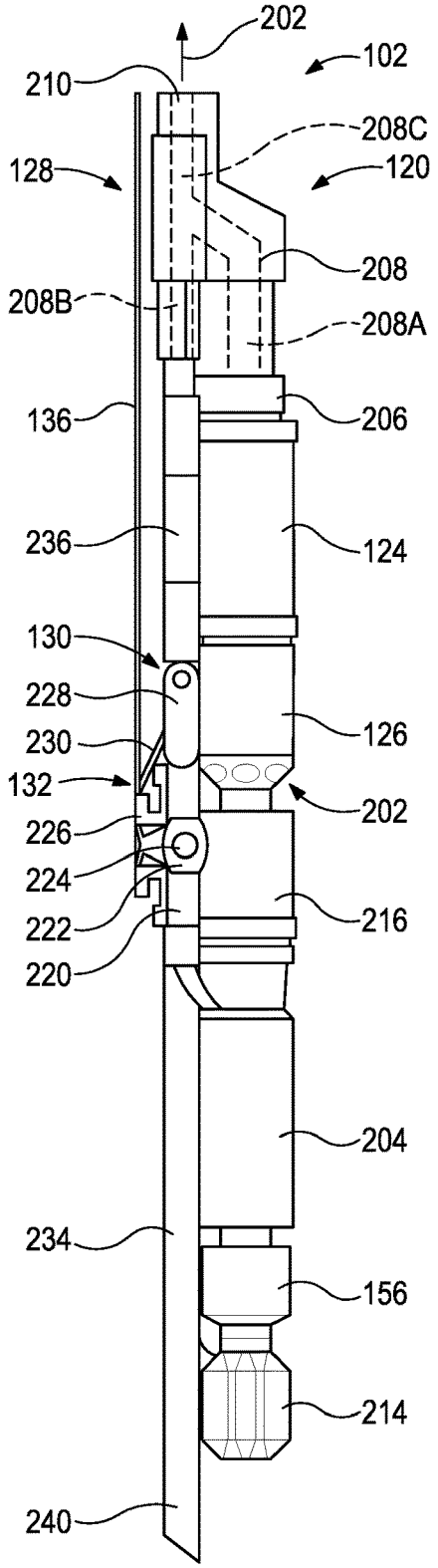
FIG. 2 is an enlarged schematic view of the Y-tool apparatus in a production configuration wherein a wellbore fluid is produced through an ESP on a production branch of the Y-tool apparatus and wherein the bypass branch is sealed.

Referring now to FIG. 2, the Y-tool apparatus 102 is illustrated in a production configuration wherein a wellbore fluid 202 may be produced through the production branch 120. As indicated above, the ESP 124 may draw the wellbore fluid 202 into the production branch 120 through intake 126. The ESP 124 may be a multi-stage centrifugal pump that operates by transferring pressure to the wellbore fluids 202 to propel the wellbore fluids 202 to the surface location "S" at a desired pumping rate. The ESP 124 may have any suitable size or construction based on the characteristics, e.g., wellbore size, desired pumping rate, etc., of the wellbore operation for which the ESP 124 is employed. The ESP 124 may operate to transfer pressure to the wellbore fluids 202 by employing a motor 204 operably coupled to one or more impellers (not shown) and diffusers (not shown) arranged within the ESP 124 as generally recognized in the art.

The wellbore fluid 202 is passed from ESP 124 to a discharge head 206, which connects the ESP 124 to a junction 208. The discharge head 124 may include a tapered interior cavity that directs the wellbore fluid 202 along a trajectory that promotes the progress of the wellbore fluid 202 in an uphole direction through the junction 208. The junction 208 includes a production conduit 208A and a bypass conduit 208B on a lower or downhole end of the junction 208, which couple to the production branch 120 and the bypass branch 128, respectively. The two production and bypass conduits 208A, 208B converge into a single upper or uphole conduit 208C that extends into a handling sub 210. The handling sub 210 includes suitable connectors for coupling the Y-tool apparatus 102 to the production tubing string 110 (FIG. 1) or another conduit. The wellbore fluid 202 may thus pass from the discharge head 206 to the junction 208, from the junction 208 to the handling sub 210, and from the handling sub 210 to the production string 110 through which the production fluid 202 may travel to the surface location "S" (FIG. 1) for production.

A motor base 214 may be arranged at a lower end of the production branch 120. The motor base 214 may include a blind plug for sealing the production branch 214, or in other embodiments, the motor base 214 may include a sampling tube for supplying samples of wellbore fluid to the sensor 156. A seal section 216 may be provided between the motor 204 and the ESP 124. The seal section 216 generally transmits torque between the motor 204 and the ESP 124, restricts the flow of wellbore fluids 202 into the motor 204, absorbs axial thrust imparted by the pump and may perform other functions as appreciated by those skilled in the art.

When the Y-tool apparatus 102 is in the production configuration, and wellbore fluid 202 is being produced, the bypass branch 128 may normally be closed. For example, as illustrated in FIG. 2, the closure valve 132 is arranged such that a bypass passage 220 extending through the bypass branch 128 is closed by a valve member 222. The closure valve 132 is illustrated as a ball valve wherein the valve member 222 is a ball having a passageway 224 extending therethrough. The bypass passage 220 of the bypass branch 128 is closed when the passageway 224 of the valve member 222 is arranged orthogonally to the bypass passage 220. An actuator 226 of the closure valve 132 may be operably coupled to the valve member 222 to selectively move the valve member 222 between the closed configuration, as shown in FIG. 2, and an open configuration (see FIG. 3) where the passageway 224 of the valve member 222 is aligned with the bypass passage 220. The actuator 226 is responsive to an appropriate control signal, which may be supplied through the control line 136, to move the valve member 222. The actuator 226 may include mechanisms such as hydraulic cylinders, rotary motors, linear slides or other mechanisms for inducing a mechanical motion in response to receiving an appropriate control signal.

The valve member 222 may be constructed of a millable material such as cast iron, aluminum or a composite material such that the valve member 222 may be milled to open the bypass passage 220 if the closure valve 132 is damaged or malfunctions, for example. In other embodiments, the closure valve 132 may include other types of valves such as a gate valve, a flapper valve, a butterfly valve, etc.

In some embodiments, the bypass passage 220 of the bypass branch 128 may further be closed by the dynamic seal 130. The dynamic seal 130 may be constructed of one or more inflatable elastomeric chambers 228 operably coupled to an extension 230 of the control line 136. The inflatable elastomeric chambers 228 may be inflated with hydraulic fluid provided through the extension 230, and when inflated, may extend fully across the bypass passage 220. Thus, the bypass passage 220 may be closed when there is no coiled tubing string 144 extending therethrough to prevent the circulation of production fluids 202 through the bypass branch 128. The extension 230 may extend between the actuator 226 and chambers 228 such that the same control line 136 may operate both the closure valve 130 and the dynamic seal 132.

The actuator 226 may operate the closure valve 130 and the dynamic seal 132 independently of one another. The actuator 226 may selectively deflate the elastomeric chambers 228 of the dynamic seal 132 and close the closure valve 130 while production fluids 202 are being produced. To conduct a coiled tubing intervention, the actuator 226 may open the closure valve 130 with a low pressure to permit passage of a coiled tubing string 144. The actuator 226 may then provide a higher pressure to the elastomeric chambers 228 of the dynamic seal 132 such that the elastomeric chambers 228 form a seal with the coiled tubing string 144. The required pressure will depend on the size of the coiled tubing string 144. A check valve (not shown) may be provided in the extension 230 to ensure fluid does not flow out of the chambers 230. The actuator 226 may selectively release the pressure to deflate the elastomeric chambers 228 and, once the coiled tubing string has been withdrawn, close the closure valve 130. This arrangement permits a single control line 136 to pass through the packer 134, which may be helpful since ports through the packer 134 may be limited. The same hydraulic fluid used to operate the closure valve 130 may be delivered through the extension 230 to the chambers 228, to expand the chambers 228 to fill and seal the bypass passage 220. The dynamic seal 130 together with the closure valve 132 prevent wellbore fluids 202 pumped by the ESP into the junction 208 from flowing down through the bypass passage 220. In other embodiments, the dynamic seal 130 may not extend entirely across the bypass passage 220 in the production configuration, and the closure valve 132 alone may seal the bypass passage 220.

In addition to the dynamic seal 130 and the closure valve 132, the bypass branch 128 may also include a reentry guide 234 coupled below or otherwise extending from the closure valve 132 and bypass tubing 236 coupled between the dynamic seal 130 and the junction 208. The reentry guide 234 may be constructed of a hollow tube having a tapered end 240 at a distal or lower-most end of the Y-tool apparatus 102. The reentry guide 234 may facilitate entry of the Y-tool apparatus 102 in a lateral wellbore (not shown) or transitioning from a vertical to a horizontal portion of a wellbore. The bypass tubing 236 may be constructed of a hollow tubing fluidly coupling the junction 208 with the closure valve 132. In some embodiments, the dynamic seal 130 may be supported within the bypass tubing 236, and in other embodiments, the dynamic seal may be supported in a separate housing coupled to the bypass tubing 236.

Figure 3:
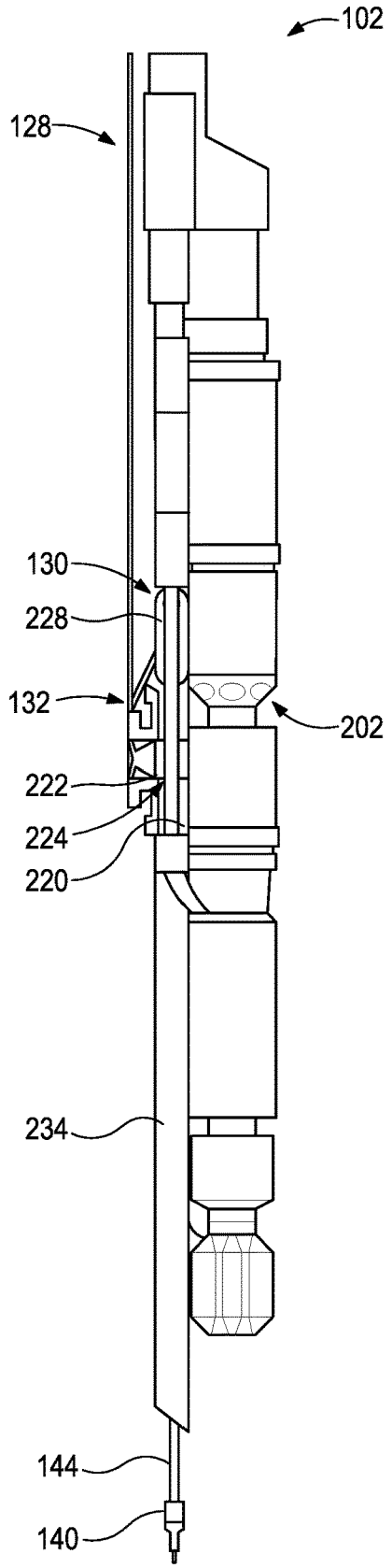
FIG. 3 is an enlarged schematic view of the Y-tool in a bypass configuration wherein an intervention tool is delivered through a bypass branch of the Y-tool to a wellbore location downhole of the ESP.

Referring now to FIG. 3, the Y-tool apparatus 102 is illustrated in a bypass configuration where the intervention tool 140 is passed through the bypass branch 128. The intervention tool 140 may be supported by the coiled tubing string 144, which passes through the production tubing string 110 (FIG. 1) from the surface location "S" (FIG. 1). The coiled tubing string 144 extends out of the reentry guide 234 and supports the intervention tool 140 at the reservoir or wellbore portion 142 (FIG. 1) below the ESP 124. When the Y-tool apparatus 102 is in the bypass configuration, wellbore fluids 202 may continue being produced through the production branch 120.

In the bypass configuration, the valve member 222 of the closure valve 132 is rotated such that the passageway 224 is aligned with the bypass passage 220 of the bypass branch 128. The coiled tubing string 144 passes through the passageway 224 of the closure valve 132 and also the dynamic seal 130. The force applied by the chambers 228 of the dynamic seal 130 may be adjusted to appropriately maintain a seal around the coiled tubing string 144 whether the coiled tubing string 144 is moving or stationary within the dynamic seal 130. The controller 154 may monitor the inflation pressure of the chambers 228 to ensure an appropriate seal is maintained. The dynamic seal 130 thus prevents any backflow of the wellbore fluids 202 from the junction 208 through the bypass branch 128 while the intervention tool 140 is being conveyed, conducting and intervention operation and being withdrawn.

Figure 4:
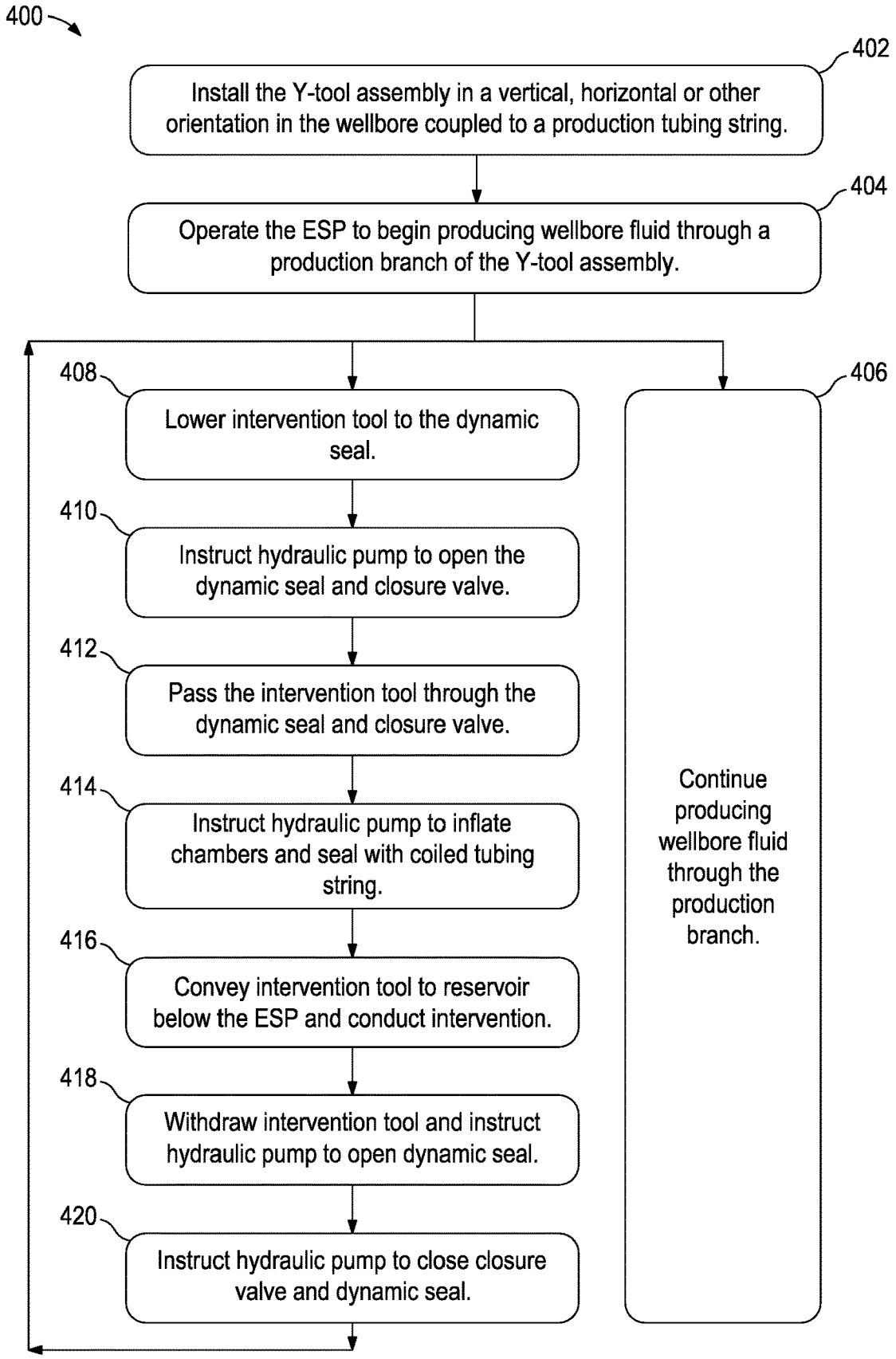
FIG. 4 is a flowchart illustrating a procedure for producing a wellbore fluid and conducting an intervention in a wellbore with the ESP Y-tool of FIG. 1.

Referring now to FIG. 4, and with continued reference to FIGS. 1-3, an example method or procedure 400 is illustrated for conducting an intervention operation in the wellbore 106 with the Y-tool apparatus 102. Initially at step 402, the Y-tool apparatus 102 may be installed in the wellbore 106 in a production configuration wherein the dynamic seal 130 and closure valve 132 close the bypass passage 220. The Y-tool apparatus 102 may be installed in a vertical orientation as illustrated in FIG. 1, or in some embodiments, the Y-tool apparatus 102 may be guided into a deep lateral branch or a horizontal portion of a wellbore. The Y-tool apparatus 102 may be lowered on the production tubing string 110 or the production tubing string 110 may be coupled to the Y-tool apparatus 102 once the Y-tool apparatus 102 has been installed.

Next at step 404, the ESP 124 may be operated to produce wellbore fluids 202 to the surface location "S." The ESP 124 may draw wellbore fluids 202 through the intake 126 and impart energy to the wellbore fluids 202 to flow the wellbore fluids 202 to the surface location "S" through the production tubing string 110. As indicated by step 406, the ESP 124 may continue to operate as steps 408 through step 420 are performed to conduct an intervention in the wellbore 106.

At step 408, the intervention tool 140 may be lowered through the wellhead 112 to the dynamic seal 130. The seal 152 in the wellhead 112 prevents wellbore fluids 202 from escaping the wellhead 112 as the coiled tubing string 144 is deployed into the wellbore 106. Once the intervention tool 140 reaches the dynamic seal 130, the controller 154 may instruct the hydraulic pump 138 to operate to open the dynamic seal (if necessary) and to open the closure valve 132 (step 410). The hydraulic pump 138 may provide a sufficient hydraulic pressure to the actuator 226 to rotate the closure member 222 to align the passageway 224 with the bypass passage 220.

The intervention tool 140 may then be passed through the dynamic seal 130 and the closure valve 132 (step 412). At step 414, the controller 154 may again instruct the hydraulic pump 138 to operate to inflate the chambers 228 of the dynamic seal 130 and form a seal with the coiled tubing string 144. The hydraulic pump 138 may increase the hydraulic pressure supplied to the actuator 226, for example, to supply hydraulic fluid or another fluid through the extension 230. The fluid supplied through the extension 230 may increase a pressure that the chambers 228 apply to the coiled tubing string 144. The controller 154 may determine a pressure that is specific to the size and type of coiled tubing string 144. The pressure may be sufficient to form a seal with the coiled tubing string 144, but not so great as to inhibit movement of the coiled tubing string 144 through the dynamic seal 130.

The procedure 400 may then proceed to step 416 where the intervention tool 140 is conveyed to the reservoir or wellbore portion 142 below the ESP 124. The dynamic seal 130 maintains a seal with the coiled tubing string 144 as the intervention tool 140 is lowered. The dynamic seal 130 prevents wellbore fluid 202 from flowing downhole through the bypass branch 128. The intervention may then be conducted with the intervention tool 140 as the wellbore fluid 202 continues being produced with the ESP 124.

At step 418, the intervention tool 140 may be withdrawn in an uphole direction on the coiled tubing string 144. Once the intervention tool 140 reaches the dynamic seal, the controller 154 may instruct the hydraulic pump 138 to open the dynamic seal. The hydraulic pressure supplied to the actuator 226 may be reduced, for example, to permit the chambers 228 to deflate and allow passage of the intervention tool 140 therethrough. Once the intervention tool 140 is withdrawn through the dynamic seal, the controller 154 may instruct the hydraulic pump 138 to close the closure valve 132, and the dynamic seal 130 (if necessary). The intervention tool 140 may be withdrawn from the wellbore 106 while production of the wellbore fluid 202 through the production branch 210 continues.

The procedure 400 may repeatedly return to step 408 to conduct additional interventions as necessary. Each intervention may be conducted with a different size of a coiled tubing string to permit various different types of interventions to be conducted. The procedure 400 may eliminate slickline runs to retrieve and reset a blanking plug. Such a slickline run may be difficult, especially when the ESP 124 is installed in deep horizontal portions of a wellbore wherein a slickline may not be able to rely on gravity for conveyance.

Embodiments disclosed herein include:

A. A Y-tool apparatus for conducting intervention operations in a wellbore is disclosed and includes a junction including a production conduit and a bypass conduit. converging into an upper conduit within the junction. The Y-tool apparatus may further include an electrical submersible pump (ESP) fluidly coupled to the production conduit in a production branch of the Y-tool apparatus and a bypass passage fluidly coupled to the bypass conduit and extending through a bypass branch of the Y-tool apparatus. A closure valve may be disposed in the bypass passage and selectively operable to move between a closed configuration, wherein flow through the bypass passage is obstructed, and an open configuration, wherein flow through the bypass passage is unobstructed. A dynamic seal may be provided in the bypass passage and selectively operable to form a seal with a tubing string passing through the bypass passage.

B. A system for conducting intervention operations in a wellbore is disclosed and includes a production tubing string extending into the wellbore and a junction coupled to a lower end of the production tubing string. The junction may include a production conduit and a bypass conduit, the production conduit and the bypass conduit converging into an upper conduit within the junction. An electrical submersible pump (ESP) may be fluidly coupled to the production conduit in a production branch of the Y-tool apparatus. A bypass passage is fluidly coupled to the bypass conduit and extends through a bypass branch of the Y-tool apparatus. A closure valve may be provided in the bypass passage, and the closure valve may be selectively operable to move between a closed configuration wherein flow through the bypass passage is obstructed and an open configuration wherein flow through the bypass passage is unobstructed. A dynamic seal may be provided in the bypass passage, the dynamic seal being selectively operable to form a seal with a tubing string passing through the bypass passage.

C. A method for conducting an intervention operation in a wellbore is disclosed and includes installing a Y-tool apparatus at a downhole location in the wellbore, operating an electrical submersible pump (ESP) coupled in a production branch of the Y-tool apparatus to propel a wellbore fluid to a surface location, conveying an intervention tool on a tubing string to a bypass passage extending through a bypass branch of the Y-tool apparatus, opening a closure valve in the bypass passage to permit passage of the intervention tool through the bypass passage to a wellbore portion downhole of the ESP, forming a dynamic seal with the tubing string above the intervention tool with a dynamic seal supported by the Y-tool apparatus and performing the intervention operation with the intervention tool disposed in the wellbore portion downhole of the ESP.

Each of embodiments A, B, and C may have one or more of the following additional elements in any combination: Element 1: wherein the dynamic seal includes at least one inflatable chamber supported in the bypass branch of the Y-tool apparatus. Element 2: further comprising an actuator operably coupled to both the closure valve and the dynamic seal. Element 3: further comprising a hydraulic control line extending to the actuator, wherein the actuator is responsive to a control signal provided through the control line to move the closure valve between the open and closed configurations and to adjust an inflation pressure of the at least one inflatable chamber. Element 4: wherein the closure valve is a ball valve including a rotatable valve member defining a passageway therethrough. Element 5: further comprising a reentry guide coupled in the bypass branch, the reentry guide including a tapered end defining a distal end of the Y-tool apparatus. Element 6: further comprising a sensor operable to detect a condition of a wellbore fluid entering an intake of the production branch.

Element 7: wherein the tubing string includes a coiled tubing string passing thought the closure valve and forming the seal with the dynamic seal, and wherein the system further comprises an intervention tool supported on the coiled tubing string. Element 8: wherein the intervention tool is a production logging tool operable to evaluate conditions within the wellbore below the ESP. Element 9: further comprising a hydraulic actuator operably coupled to both the closure valve and the dynamic seal, the actuator being responsive to a control signal provided through a control line extending to a surface location to move the closure valve between the open and closed configurations and to adjust a sealing pressure of the dynamic seal. Element 10: further comprising a controller and a hydraulic pump operably coupled to the actuator by the control line, wherein controller is operable to instruct the hydraulic pump to provide a hydraulic signal as the control signal. Element 11: The system of claim 12, further comprising a packer disposed around the production tubing string, and wherein the control line passes through the packer. Element 12: wherein the ESP is a multistage centrifugal pump employing a motor operably coupled to one or more impellers and diffusers to propel wellbore fluids through the production tubing string to a surface location.

Element 13: wherein forming the dynamic seal includes inflating at least one elastomeric chamber around the tubing string. Element 14: further comprising selecting a sealing force based on a diameter of the tubing string and wherein inflating the at least one elastomeric chamber includes providing a sufficient inflation pressure to provide the sealing force to the tubing string with at least one elastomeric chamber. Element 15: wherein installing the Y-tool apparatus includes installing the Y-tool apparatus in a horizontal orientation in the wellbore. Element 16: wherein opening the closure valve and forming the dynamic seal both include providing a hydraulic signal to an actuator operably coupled to the closure valve and the dynamic seal. Element 17: wherein conveying the intervention tool is performed while operating the ESP.

By way of non-limiting example, exemplary combinations applicable to A, B. and C include: Element 1 with Element 2; Element 2 with Element 3; Element 7 with Element 8; Element 7 with Element 9; Element 9 with Element 10; Element 10 with Element 11 and Element 13 with Element 14.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising." and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the wellbore and the downhole direction being toward the toe of the wellbore.

The invention claimed is:

1. A Y-tool apparatus for conducting intervention operations in a wellbore, the Y-tool apparatus comprising:

a junction including a production conduit and a bypass conduit, the production conduit and the bypass conduit converging into an upper conduit within the junction;

an electrical submersible pump (ESP) fluidly coupled to the production conduit in a production branch of the Y-tool apparatus;

a bypass passage fluidly coupled to the bypass conduit and extending through a bypass branch of the Y-tool apparatus;

a closure valve disposed in the bypass passage and selectively operable to move between a closed configuration, wherein flow through the bypass passage is obstructed, and an open configuration, wherein flow through the bypass passage is unobstructed; and a dynamic seal provided in the bypass passage and selectively operable to form a seal with a tubing string passing through the bypass passage.

2. The apparatus of claim 1, wherein the dynamic seal includes at least one inflatable chamber supported in the bypass branch of the Y-tool apparatus.

3. The apparatus of claim 2, further comprising an actuator operably coupled to both the closure valve and the dynamic seal.

4. The apparatus of claim 3, further comprising a hydraulic control line extending to the actuator, wherein the actuator is responsive to a control signal provided through the control line to move the closure valve between the open and closed configurations and to adjust an inflation pressure of the at least one inflatable chamber.

5. The apparatus of claim 1, wherein the closure valve is a ball valve including a rotatable valve member defining a passageway therethrough.

6. The apparatus of claim 1, further comprising a reentry guide coupled in the bypass branch, the reentry guide including a tapered end defining a distal end of the Y-tool apparatus.

7. The apparatus of claim 1, further comprising a sensor operable to detect a condition of a wellbore fluid entering an intake of the production branch.

8. A system for conducting intervention operations in a wellbore, the system comprising:

a production tubing string extending into the wellbore;

a junction coupled to a lower end of the production tubing string, the junction including a production conduit and a bypass conduit, the production conduit and the bypass conduit converging into an upper conduit within the junction;

an electrical submersible pump (ESP) fluidly coupled to the production conduit in a production branch of the Y-tool apparatus;

a bypass passage fluidly coupled to the bypass conduit and extending through a bypass branch of the Y-tool apparatus;

a closure valve provided in the bypass passage, the closure valve being selectively operable to move between a closed configuration wherein flow through the bypass passage is obstructed and an open configuration wherein flow through the bypass passage is unobstructed; and a dynamic seal provided in the bypass passage, the dynamic seal being selectively operable to form a seal with a tubing string passing through the bypass passage.

9. The system of claim 8, wherein the tubing string includes a coiled tubing string passing thought the closure valve and forming the seal with the dynamic seal, and wherein the system further comprises an intervention tool supported on the coiled tubing string.

10. The system of claim 9, wherein the intervention tool is a production logging tool operable to evaluate conditions within the wellbore below the ESP.

11. The system of claim 9, further comprising a hydraulic actuator operably coupled to both the closure valve and the dynamic seal, the actuator being responsive to a control signal provided through a control line extending to a surface location to move the closure valve between the open and closed configurations and to adjust a sealing pressure of the dynamic seal.

12. The system of claim 11, further comprising a controller and a hydraulic pump operably coupled to the actuator by the control line, wherein controller is operable to instruct the hydraulic pump to provide a hydraulic signal as the control signal.

13. The system of claim 12, further comprising a packer disposed around the production tubing string, and wherein the control line passes through the packer.

14. The system of claim 8, wherein the ESP is a multistage centrifugal pump employing a motor operably coupled to one or more impellers and diffusers to propel wellbore fluids through the production tubing string to a surface location.

15. A method for conducting an intervention operation in a wellbore, the method comprising:

installing a Y-tool apparatus at a downhole location in the wellbore;

operating an electrical submersible pump (ESP) coupled in a production branch of the Y-tool apparatus to propel a wellbore fluid to a surface location;

conveying an intervention tool on a tubing string to a bypass passage extending through a bypass branch of the Y-tool apparatus;

opening a closure valve in the bypass passage to permit passage of the intervention tool through the bypass passage to a wellbore portion downhole of the ESP;

forming a dynamic seal with the tubing string above the intervention tool with a dynamic seal supported by the Y-tool apparatus; and performing the intervention operation with the intervention tool disposed in the wellbore portion downhole of the ESP.

16. The method of claim 15, wherein forming the dynamic seal includes inflating at least one elastomeric chamber around the tubing string.

17. The method of claim 16, further comprising selecting a sealing force based on a diameter of the tubing string and wherein inflating the at least one elastomeric chamber includes providing a sufficient inflation pressure to provide the sealing force to the tubing string with at least one elastomeric chamber.

18. The method of claim 15, wherein installing the Y-tool apparatus includes installing the Y-tool apparatus in a horizontal orientation in the wellbore.

19. The method of claim 15, wherein opening the closure valve and forming the dynamic seal both include providing a hydraulic signal to an actuator operably coupled to the closure valve and the dynamic seal.

20. The method of claim 15, wherein conveying the intervention tool is performed concurrently with operating the ESP.

* * * * *